US009892709B2

(12) United States Patent
Choi et al.

(10) Patent No.: US 9,892,709 B2
(45) Date of Patent: Feb. 13, 2018

(54) DISPLAY DEVICE AND DRIVING METHOD THEREOF

(71) Applicant: Samsung Display Co., LTD., Yongin, Gyeonggi-Do (KR)

(72) Inventors: Jae Ho Choi, Seoul (KR); Sil Yi Bang, Yongin-si (KR); Jang Hyun Yeo, Seoul (KR); Myeong Su Kim, Hwaseong-si (KR)

(73) Assignee: Samsung Display Co., Ltd. (KR)

( * ) Notice: Subject to any disclaimer, the term of this patent is extended or adjusted under 35 U.S.C. 154(b) by 250 days.

(21) Appl. No.: 14/293,856

(22) Filed: Jun. 2, 2014

(65) Prior Publication Data

US 2015/0206467 A1 Jul. 23, 2015

(30) Foreign Application Priority Data

Jan. 20, 2014 (KR) ..... 10-2014-0006912

(51) Int. Cl.
*G09G 5/00* (2006.01)
*G09G 3/20* (2006.01)

(52) U.S. Cl.
CPC ..... *G09G 5/003* (2013.01); *G09G 3/2055* (2013.01); *G09G 2340/0428* (2013.01)

(58) Field of Classification Search
CPC ..... G09G 3/20; G09G 2340/16
See application file for complete search history.

(56) References Cited

U.S. PATENT DOCUMENTS 7,123,246 B2 10/2006 Nakatani et al.
7,889,166 B2 2/2011 Moon
2005/0225565 A1* 10/2005 Seong ..... G09G 3/2059 345/611
2008/0198173 A1* 8/2008 Coates ..... G09G 3/18 345/596
2010/0026722 A1* 2/2010 Kondo ..... G09G 3/2007 345/660
2013/0257897 A1* 10/2013 Kim ..... G09G 3/2025 345/596

(Continued)

FOREIGN PATENT DOCUMENTS

JP 3749147 B 12/2005
JP 2006-189661 A 7/2006

(Continued)

*Primary Examiner* — Kent Chang
*Assistant Examiner* — Scott Au
(74) *Attorney, Agent, or Firm* — Innovation Counsel LLP

(57) ABSTRACT

The inventive concept relates to a display device and a driving method thereof. A display device according to an exemplary embodiment of the inventive concept includes: a display panel including a plurality of pixels and a plurality of data lines; a data driver applying data voltages to the plurality of data lines; a signal controller controlling the data driver; and a graphic controller inputting an image signal that is dithered based on dithering patterns of one set to the signal controller, wherein the signal controller includes a dithering cycle detector configured to detect a dithering cycle which is a cycle in which the dithering patterns of one set are repeated, and a still image detector configured to determine whether a current frame is a frame displaying a still image or a frame displaying a motion picture image based on the dithering cycle and the image signal.

14 Claims, 14 Drawing Sheets

(56) References Cited

U.S. PATENT DOCUMENTS

| | | | | |
|---|---|---|---|---|
| 2013/0321477 | A1* | 12/2013 | Gandhi | G09G 3/2022 345/690 |
| 2015/0062149 | A1* | 3/2015 | Chiang | G09G 5/18 345/596 |

FOREIGN PATENT DOCUMENTS

| | | | |
|---|---|---|---|
| KR | 10-0522706 | B1 | 10/2005 |
| KR | 10-0713644 | B1 | 5/2007 |
| KR | 10-2013-0062109 | A | 6/2013 |

* cited by examiner

FIG. 14

※ FSUM(Frame #, ··· )

↓

1. FSUM(1,2,3,4) = 82
2. FSUM(2,3,4,5) = 82
3. FSUM(3,4,5,6) = 82
4. FSUM(4,5,6,7) = 82

≠

5. FSUM(5,6,7,8) = 202
6. FSUM(6,7,8,9) = 322
7. FSUM(7,8,9,10) = 442

DISPLAY DEVICE AND DRIVING METHOD THEREOF

CROSS-REFERENCE TO RELATED APPLICATION

This application claims priority to and the benefit of Korean Patent Application No. 10-2014-0006912 filed in the Korean Intellectual Property Office on Jan. 20, 2014, the entire contents of which are incorporated herein by reference.

BACKGROUND (a) Technical Field

The inventive concept relates to a display device and a driving method thereof.

(b) Description of the Related Art

A display device is required for a computer monitor, a television, a mobile phone, and the like, which are widely used today. Display devices include a liquid crystal display (LCD) and an organic light emitting diode (OLED) display.

The display device generally includes a graphic controller (GPU, graphics processing unit), a display panel including a plurality of pixels including a switching element and a plurality of signal lines, a data driver generating a plurality of gray voltages and applying a gray voltage corresponding to an input image signal among the generated gray voltages to a data line as a data signal, a gate driver generating and applying a gate signal to a gate line, and a signal controller controlling the gate driver and the data driver.

The graphic controller receives image information from the outside, generates an input image signal and an input control signal based on the image information, and transmits the input image signal and the input control signal to the signal controller. The signal controller appropriately processes the input image signal based on the input control signal to generate an output image signal and several control signals. The data driver selects the gray voltage corresponding to the output image signal input from the signal controller and applies it to the data line of the display panel as the data voltage.

The image displayed on the display device may be largely classified into a still image and a moving image. The display panel displays images of various frames per second, and if the image signals of the adjacent frames are the same as each other, the display panel may display the stationary image, while if the image signals of the adjacent frames are different from each other, the display panel may display the motion picture. The signal controller receives the input image signal for every frame from the graphics processing unit. In the case where the stationary image is displayed, the same input image signal is received for every frame. Thus, unnecessary power consumption may be increased. Accordingly, it is necessary to reduce power consumption by operating the display panel with a low power mode when displaying the still image. For example, when displaying the still image, the step of transmitting the same input image signal from the graphic controller to the signal controller may be omitted. Particularly, demand for a low power consumption device has increased for the display device used in a portable terminal such as a laptop computer and a tablet computer.

Generally, a bit number of the input image signal that is processed in the graphic controller and a bit number that can be processed in the signal controller are the same, and a bit number of the output image signal that is processed in the signal controller and a bit number that can be processed in the data driver are the same. However, when the bit numbers of the input image signal, the bit number that can be processed in the signal controller and the bit number that can be processed in the data driver are different, a dithering method of reconfiguring the image signal may be used. The dithering method uses only upper bits corresponding to the bit number that can be processed in the signal controller or the data driver among the bits of the input image signal or the output image signal, and modify the upper bits to represent lower bits using dithering patterns. For example, the dithering pattern may be a compensation value group corresponding to pixels. A resolution of a gray scale image may be increased by minutely controlling the luminance by using this dithering method. For this purpose, the display device may store a plurality of different dithering patterns for each gray and each frame for the dithering. The dithering patterns may be repeated periodically, for example, the dithering patterns may be repeated every several frames, and this cycle is referred to as a dithering cycle.

The above information disclosed in this Background section is only for enhancement of understanding of the background of the inventive concept and therefore it may contain information that does not form the prior art.

SUMMARY

As described above, to divide the still image and to operate the display device with the low power mode, it is necessary to distinguish the still image and the motion picture image in the signal controller. However, the input image signal output from the graphic controller may be dithered and output such that the image to be displayed may be recognized as the motion picture image in the signal controller although the image to be displayed is the still image.

Accordingly, the inventive concept provides a display device correctly detecting a dithering cycle as a cycle in which the dithering pattern applied to the input image signal output from the graphic controller is repeated, and a driving method thereof.

The inventive concept provides a display device correctly detecting the still image or the motion picture image based on the detected dithering cycle, and a driving method thereof.

A display device according to an exemplary embodiment of the inventive concept includes: a display panel including a plurality of pixels and a plurality of data lines; a data driver applying data voltages to the plurality of data lines; a signal controller controlling the data driver; and a graphic controller inputting an image signal that is dithered based on dithering patterns of one set to the signal controller, wherein the signal controller includes a dithering cycle detector configured to detect a dithering cycle which is a cycle in which the dithering patterns of one set are repeated, and a still image detector configured to determine whether a current frame is a frame displaying a still image or a frame displaying a motion picture image based on the dithering cycle and the image signal.

The dithering cycle detector may is configured to set a test region of the display panel, and store and compare data of the image signal for the test region during a plurality of frames to detect frames in which same data is repeated periodically, thereby determining the dithering cycle.

When data of a lower bit of gray information represented by the image signal for the test region is "00", the dithering cycle detector may be configured to detect the dithering cycle by repeating detection of the dithering cycle or changing the test region.

The dithering cycle detector may repeat detecting dithering cycles until a repeated dithering cycle is obtained and determine the repeated dithering cycle as the dithering cycle.

The still image detector may include a register storing a frame representative value, and the still image detector compares the frame representative value stored in the register with the frame representative value of the current frame for every dithering cycle to determine whether an image of the current frame is the still image or the motion picture image.

The still image detector may include a register storing a frame representative value.

The still image detector may compare the frame representative value stored in the register with the frame representative value of a current for every detected dithering cycle to determine whether an image of the current frame is the still image or the motion picture image.

A display area of the display panel is divided into a plurality of sub-display areas, the register may include a plurality of register units respectively storing the frame representative value for the respective plurality of sub-display areas.

The plurality of sub-display areas may be alternately repeated in one direction, and the plurality of register unit may be alternately repeated in the same direction.

The still image detector may obtain a sum value of frame representative values for two or more pixels among the pixels included in the test region and may determine that the motion picture image is generated in a frame in which the sum value be changed relatively more than other frames, or may obtain a frame sum value by accumulating and summing the sum values of a number of frames same as the dithering cycle and may determine that the motion picture image is generated in a frame in which the frame sum value be changed relatively more than other frames A driving method of a display device including a display panel including a plurality of pixels and a plurality of data lines, a data driver, a signal controller controlling the data driver, and a graphic controller according to an exemplary embodiment of the inventive concept includes: inputting an image signal that is dithered based on dithering patterns of one set to the signal controller by the graphic controller; detecting a dithering cycle which is a cycle in which the dithering pattern of one set is repeated by the signal controller; and determining whether a current frame is a frame displaying a still image or a frame displaying a motion picture image based on the dithering cycle and the image signal.

The detecting of the dithering cycle may include setting a test region of the display panel and storing and comparing data of the image signal for the test region during a plurality of frames to detect frames in which a same data is repeated.

The detecting of the dithering cycle may further include detecting the dithering cycle by repeating the detecting of the dithering cycle or changing the test region when data of a lower bit of gray information represented by the image signal for the test region is "00".

The detecting of the dithering cycle may be performed repeatedly until a repeated dithering cycle is obtained and the repeated dithering cycle among detected dithering cycles is determined as the dithering cycle The determining whether a current frame is a frame displaying a still image or a frame displaying a motion picture image may include storing a frame representative value for each frame in a register, and comparing the stored frame representative value stored in the register with the frame representative value of the current frame for every detected dithering cycle to determine whether an image of the current frame is the still image or the motion picture image.

The determining of whether the current frame is the frame displaying the still image or the frame displaying the motion picture image may include storing a frame representative value for each frame.

The determining of whether the current frame is the frame displaying the still image or the frame displaying the motion picture image may include comparing the stored frame representative value with the frame representative value of the current frame for every detected dithering cycle to determine whether an image of the current frame is the still image or the motion picture image.

A display area of display panel is divided into a plurality of sub-display areas, the storing of the frame representative value for each frame may include respectively storing the frame representative value for the respective plurality of sub-display areas.

The plurality of sub-display areas may be alternately repeated in one direction, and the storing of the frame representative value for each frame may include alternately storing the frame representative value for the respective plurality of sub-display areas.

In the determining of whether the current frame is the frame displaying the still image or the frame displaying the motion picture image, a sum value of the frame representative values for two or more pixels among the pixels included in the test region may be obtained, and it may be determined that the motion picture image is generated in a frame in which the sum value be changed relatively more than other frames, or a frame sum value may be obtained by accumulating and summing the sum values of a number of frames same as the dithering cycle, and it may be determined that the motion picture image is generated in a frame in which the frame sum value be changed relatively more than other frames.

According to an exemplary embodiment of the inventive concept, the dithering cycle as the cycle in which the dithering pattern applied to the input image signal output from the graphic controller may be correctly detected. Further, the still image may be correctly detected based on the detected dithering cycle such that various low power modes may be applied in the signal controller.

BRIEF DESCRIPTION OF THE DRAWINGS

FIG. 14 is a view showing another method of detecting a frame in which a still image or a motion picture image is generated for an image of several frames shown in FIG. 12 and FIG. 13.

DETAILED DESCRIPTION OF THE EMBODIMENTS

The inventive concept will be described more fully hereinafter with reference to the accompanying drawings, in which exemplary embodiments of the inventive concept are shown. As those skilled in the art would realize, the described embodiments may be modified in various different ways, all without departing from the spirit or scope of the inventive concept.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

Now, a display device and a driving method thereof according to an exemplary embodiment of the inventive concept will be described with reference to accompanying drawings.

Firstly, a display device according to an exemplary embodiment of the inventive concept will be described with reference to FIG. 1.

Figure 1:
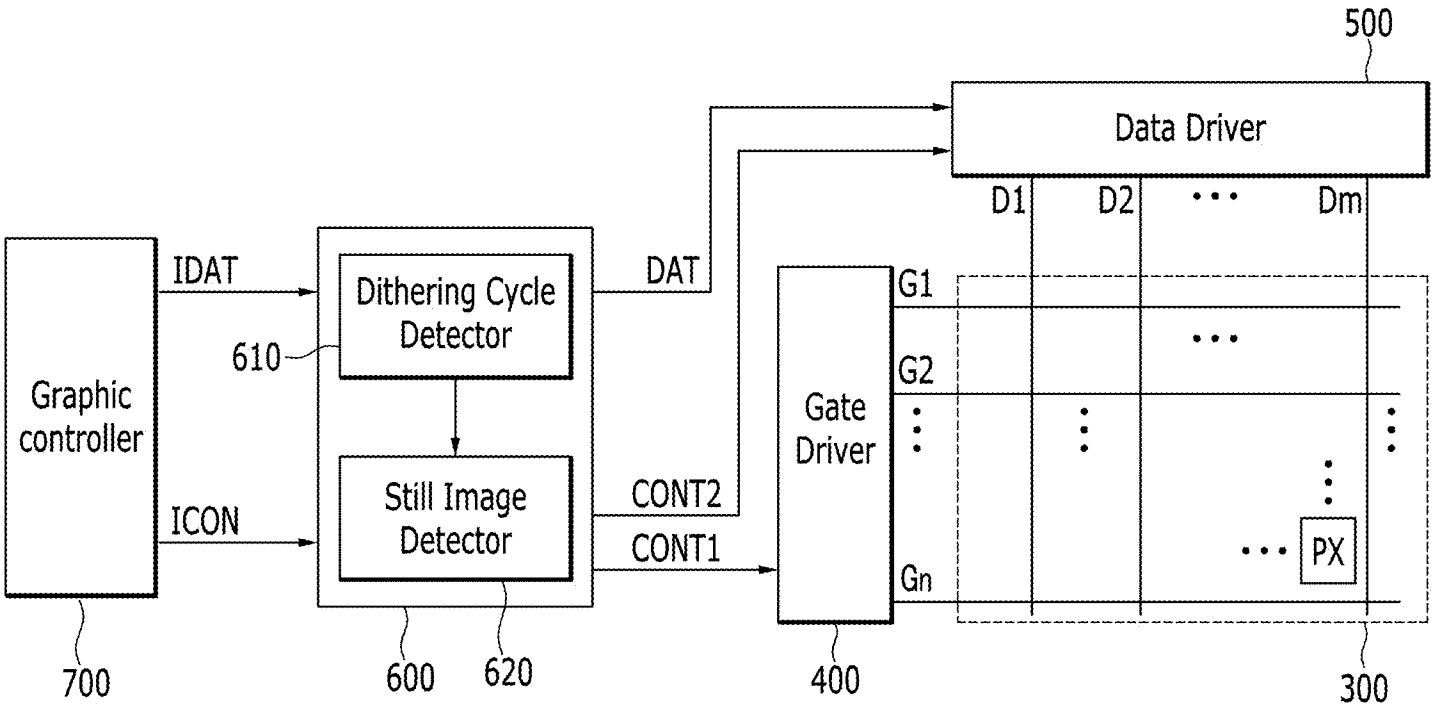
FIG. 1 is a block diagram of a display device according to an exemplary embodiment of the inventive concept.

FIG. 1 is a block diagram of a display device according to an exemplary embodiment of the inventive concept.

Referring to FIG. 1, a display device according to an exemplary embodiment of the inventive concept includes a display panel 300, a gate driver 400, a data driver 500, a signal controller 600 controlling the data driver 500 and the gate driver 400, and a graphic controller 700.

The display panel 300 may be a liquid crystal display (LCD), an organic light emitting display (OLED), and an electro wetting display (EWD).

The display panel 300 includes a plurality of gate lines G1 to Gn, a plurality of data lines D1 to Dm, and a plurality of pixels PXs which are connected to the plurality of gate lines G1 to Gn and the plurality of data lines D1 to Dm.

The gate lines G1 to Gn may transfer gate signals, and may extend substantially in a row direction and be substantially parallel with each other. The data lines D1 to Dm may transfer a data voltage, and may extend substantially in a column direction and be substantially parallel with each other.

The plurality of pixels PXs may be substantially arranged in a matrix form. A region displaying the image where the pixels PXs are arranged is referred to as a display area. Each pixel PX may include at least one switching element connected to the corresponding gate lines G1 to Gn and the corresponding data lines D1 to Dm, and at least one pixel electrode connected to the switching element. The switching element is turned on or turned off depending on the gate signals transferred by the gate lines G1 to Gn to be able to selectively transfer the data voltage transferred by the data lines D1 to Dm to the pixel electrode. Each pixel PX may display an image of the corresponding luminance depending on the data voltage applied to the pixel electrode.

The graphic controller 700 generates an input image signal IDAT and an input control signal ICON controlling the display of the input image signal IDAT by receiving and processing image information from the outside, and transfers them to the signal controller 600. The input image signal IDAT may include luminance information of each pixel PX, and the luminance may have a predetermined number of grays. An example of the input control signal ICON is a vertical synchronization signal VSync, a horizontal synchronizing signal HSync, a main clock signal, and a data enable signal.

The input image signal IDAT may be dithered to be input to the signal controller 600. The dithering is to temporally and spatially reconfigure the input image signal IDAT according to several dithering patterns that are previously stored to express the gray of the input image signal IDAT generated in the graphic controller 700. Temporal dithering is a method of representing the gray of the input image signal IDAT, that is, a target luminance, as an average gray during a plurality of continuous frames for one pixel. If the image is displayed with only the temporal dithering, a flicker may occur on a screen such that the spatial dithering may be used as an alternative. The spatial dithering is a method of controlling the adjacent pixels PXs to display the target luminance.

Figure 2:
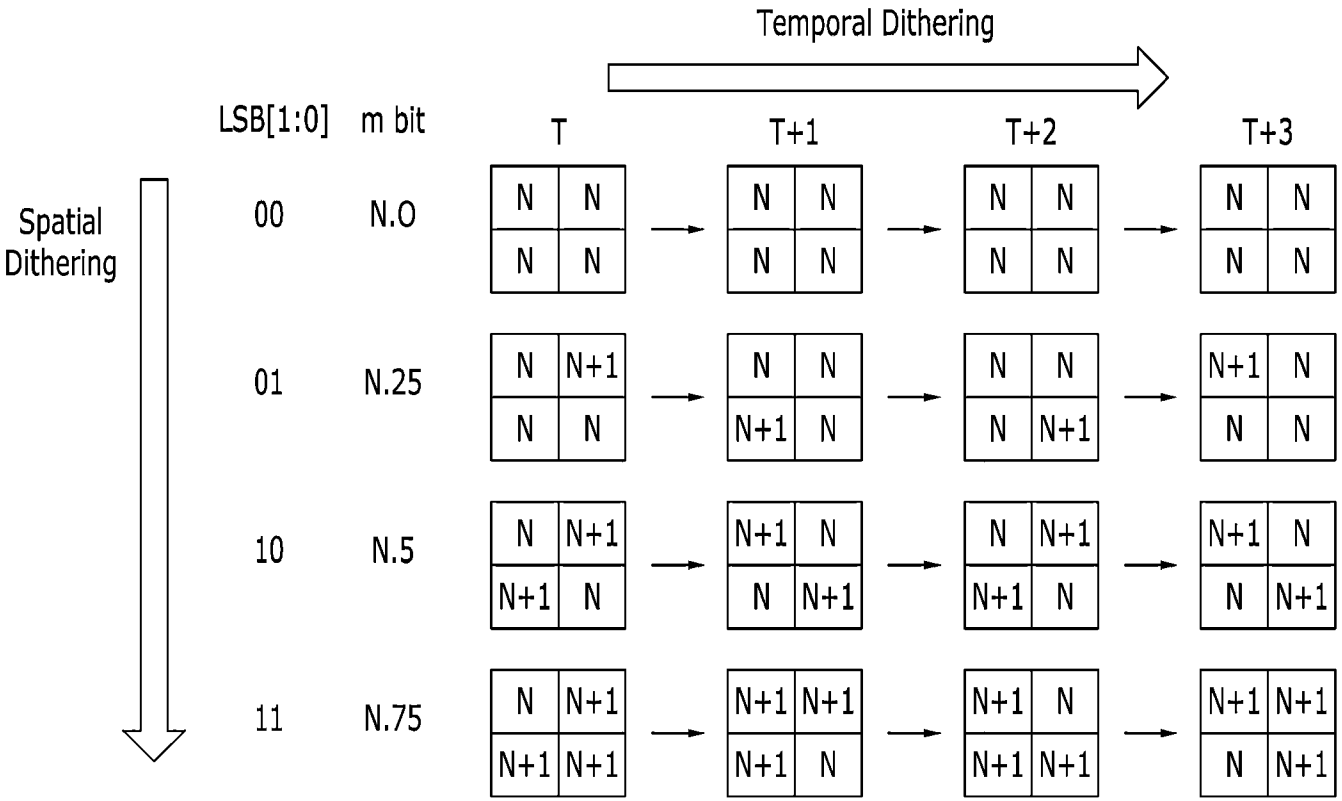
FIG. 2 is a view of one example of dithering that can be applied to an input image signal output in a graphic controller included in a display device according to an exemplary embodiment of the inventive concept.

For example, referring to FIG. 2, when the gray information to be represented by the input image signal IDAT is m bits and a bit number of the signal to be processed in the signal controller 600 is n bits, and a difference in bits between m bits and n bits is 2 bits, the gray information of the m bit may be divided into an upper bits, a data N, and a data of a lower bits, 2 bits. The data of the lower 2 bits becomes "00", "01", "10", or "11".

If the data of the lower 2 bits is "00", four adjacent pixels PXs may display the data N of the upper bits during consecutive four frames T, T+1, T+2, and T+3.

If the data of the lower 2 bits is "01", only one pixel among the adjacent four pixels alternatingly displays N+1 data (the data N of an upper bit plus "1") and the rest of the pixels display the data N of the upper bit during the consecutive four frames T, T+1, T+2 and T+3. Thus, an average luminance of four pixels and an average luminance during the consecutive four frames T, T+1, T+2, and T+3 of one pixel becomes N+0.25.

If the data of the lower 2 bits is "10", two pixels among four adjacent pixels alternatingly display N+1 data and the rest of the pixels display the data N of the upper bit during the consecutive four frames T, T+1, T+2 and T+3. Thus, the average luminance of the four pixels and the average luminance during the consecutive four frames T, T+1, T+2, and T+3 of one pixel becomes N+0.5.

When the data of the lower 2 bits is "11", three pixels among four adjacent pixels alternatingly display N+1 data and the rest of the pixels display the data N of the upper bit during the consecutive four frames T, T+1, T+2 and T+3. Thus, the average luminance of four pixels and the average luminance during four frames T, T+1, T+2, and T+3 of one pixel becomes N+0.75.

If the difference of the m bits and the n bits is a k bits (k is a natural number of 1 or more), a frame number of the dithering pattern of one set required for the temporal and spatial dithering for one gray may be $2^k$ continuous frames, and this is referred to as a dithering cycle. For example, when the lower bit of the gray information of the m bit to be displayed by the input image signal IDAT is 3 bits, the data of the lower 3 bits is "000", "001", "010", "011", "100", "101", "110", or "111".

The signal controller 600 receives the input image signal IDAT and the input control signal ICON for controlling display of the input image signal IDAT from the graphic controller 700. The signal controller 600 appropriately processes the input image signal IDAT according to the input control signal ICON to generate the output image signal DAT, and generates the scan control signal CONT1 and the data control signal CONT2 based on the input image signal IDAT and the input control signal ICON.

Referring to FIG. 1, the signal controller 600 according to an exemplary embodiment of the inventive concept may include a dithering cycle detector 610 and a still image detector 620.

The dithering cycle detector 610 detects a cycle of the dithering pattern applied to the input image signal IDAT which is supplied from the graphic controller 700, that is, a dithering cycle, and transmits a result thereof to the still image detector 620. For this, the dithering cycle detector 610 or the signal controller 600 may include a plurality of frame memories (not shown) storing the data of the input image signal IDAT of a plurality of frames.

The still image detector 620 determines whether the image displayed by the input image signal IDAT is the still image or the motion picture image using the detected dithering cycle.

Here, the still image means that images of neighboring frames are the same images, and a motion picture image means that images of neighboring frames are different images. Further, a still image section may refer to a section displaying the still image and a motion picture image section may refer to a section displaying the motion picture image.

The signal controller 600 may be operated with various low power modes when the display image is determined as the still image.

The gate driver 400 receives a gate control signal CONT1 from the signal controller 600 and generates a gate signal which is a combination of a gate-on voltage Von and a gate-off voltage Voff capable of turning on and turning off the switching element of the pixel PX based on the transferred gate control signal CONT1. The gate control signal CONT1 includes a scanning start signal STV instructing a scanning start and at least one clock signal CPV controlling output timing of the gate-on voltage Von, and at least one low voltage. The gate driver 400 is connected to the gate lines G1 to Gn of the display panel 300 to apply the gate signals to the gate lines G1 to Gn.

The data driver 500 receives a data control signal CONT2 and output image signals DAT from the signal controller 600 to select a gray voltage corresponding to each output image signal DAT, thereby converting the output image signal DAT into the data voltage which is an analog data signal. The data control signal CONT2 includes a horizontal synchronization start signal STH that notifies transmission of output image signal DAT to one row of pixels PX, and a load signal for instructing to apply the data signal to the data lines D1 to Dm. The data control signal CONT2 may further include an inversion signal that inverts a polarity of the data voltage for a common voltage Vcom (referred to as a polarity of data voltage). The data driver 500 is connected to the data lines D1-Dm of the display panel 300 to apply the data voltage to the corresponding data lines D1-Dm.

Next, a driving method of a display device according to an exemplary embodiment of the inventive concept and a method of correctly detecting the dithering cycle applied to the input image signal IDAT will be described with reference to FIG. 3 to FIG. 6 along with FIG. 1 and FIG. 2.

Figure 3:
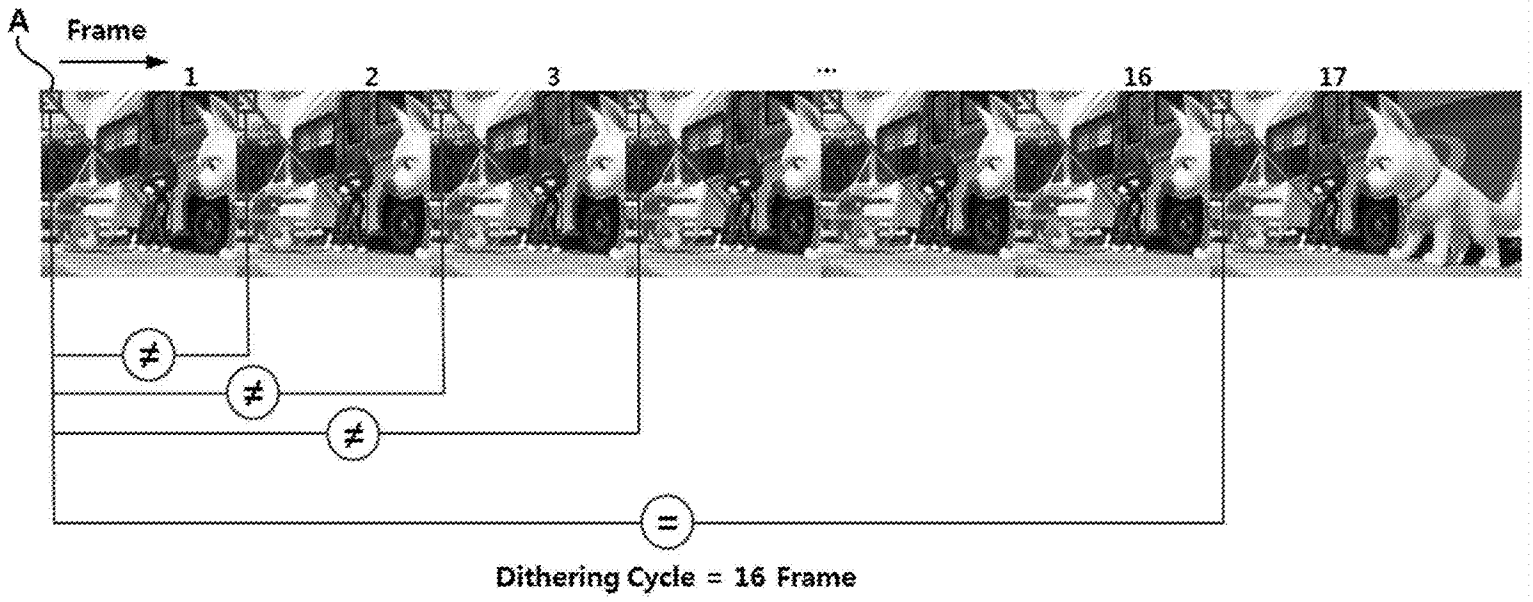
FIG. 3 is a view of a method of detecting a dithering cycle in a display device according to an exemplary embodiment of the inventive concept.
Figure 4:
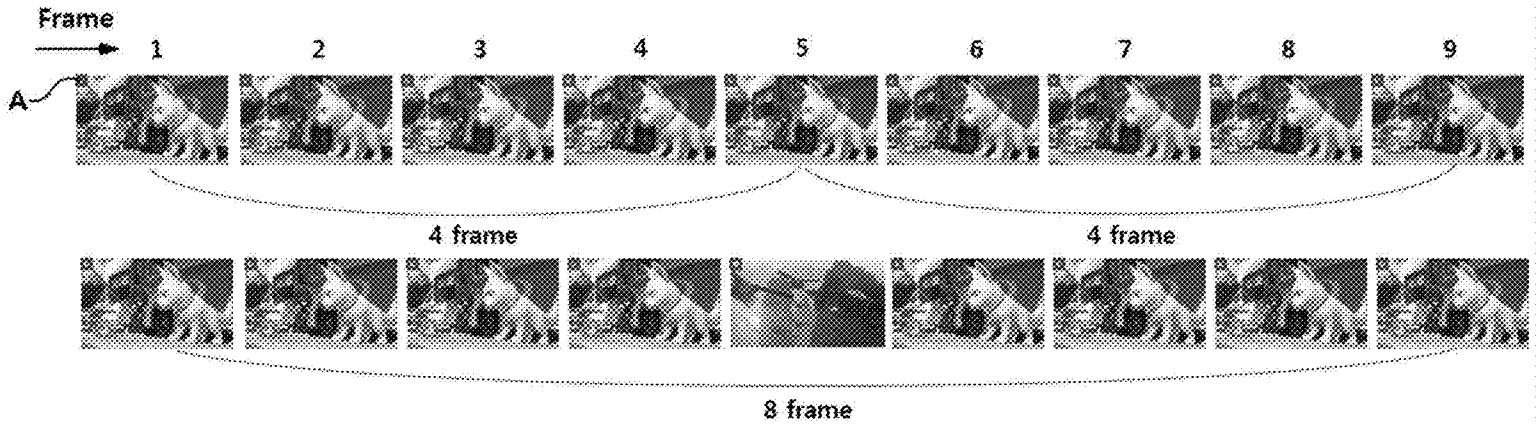
FIG. 4 is a view of a method of detecting a correct dithering cycle when a motion picture image is generated to a frame applied with the same dithering pattern in a display device according to an exemplary embodiment of the inventive concept.
Figure 5:
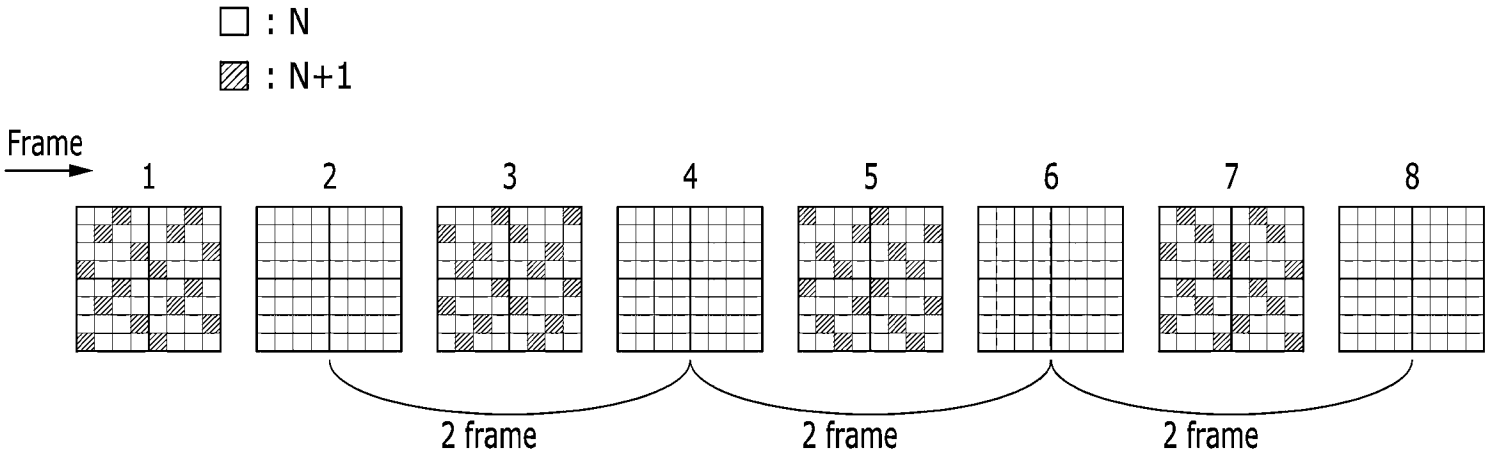
FIG. 5 is a view of an example of a dithering pattern when a dithering pattern is periodically repeated within one dithering cycle in a display device according to an exemplary embodiment of the inventive concept.
Figure 6:
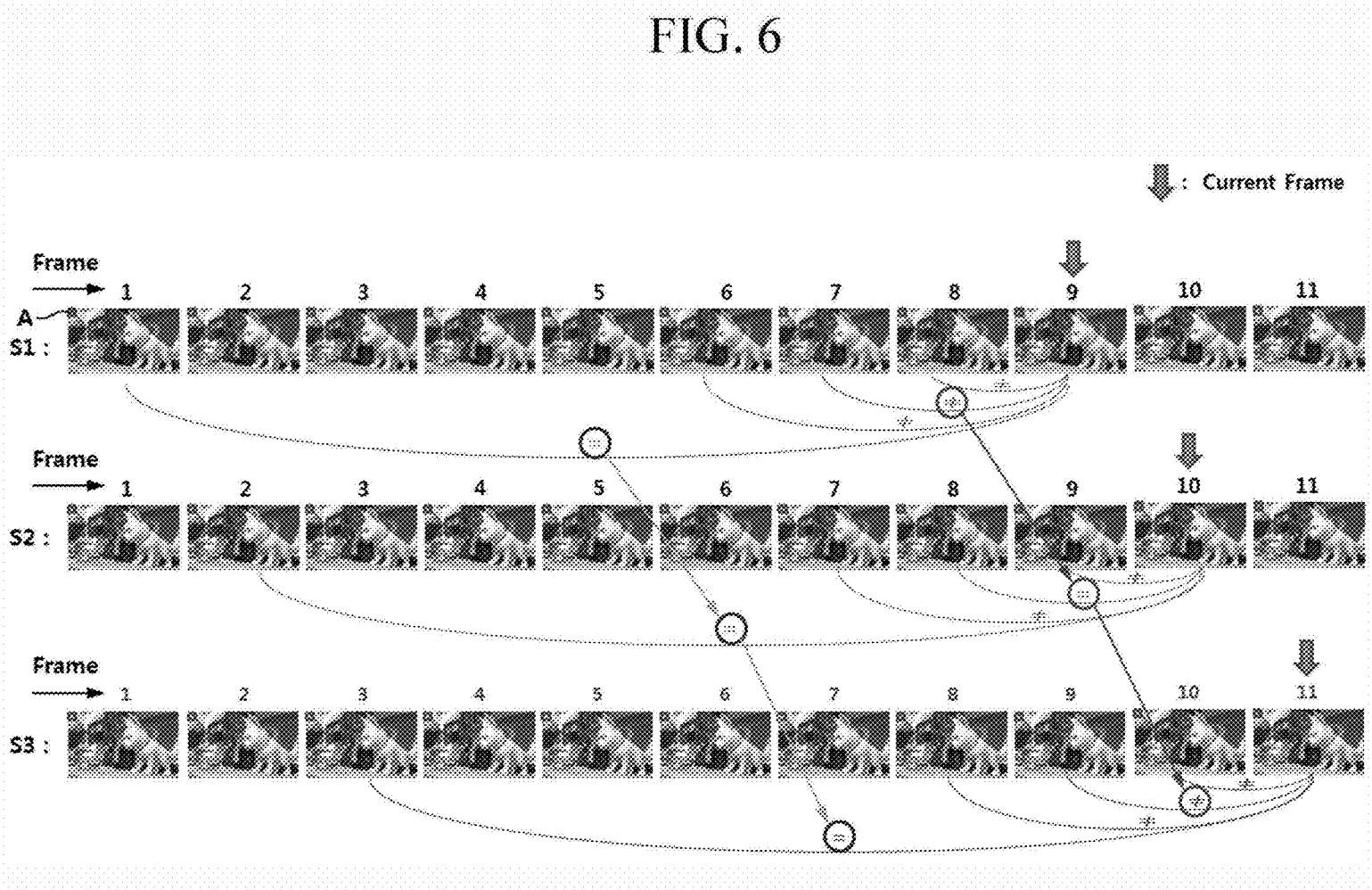
FIG. 6 is a method of detecting a correct dithering cycle when a dithering pattern is periodically repeated within one dithering cycle in a display device according to an exemplary embodiment of the inventive concept.

FIG. 3 is a view of a method of detecting a dithering cycle in a display device according to an exemplary embodiment of the inventive concept, FIG. 4 is a view of a method of detecting a correct dithering cycle when a motion picture image is generated to a frame corresponding to the same dithering pattern in a display device according to an exemplary embodiment of the inventive concept, FIG. 5 is a view of an example of a dithering pattern when same patterns are periodically repeated within one dithering cycle in a display device according to an exemplary embodiment of the inventive concept, and FIG. 6 is a method of detecting a correct dithering cycle when a dithering pattern is periodically repeated within one dithering cycle in a display device according to an exemplary embodiment of the inventive concept.

Firstly, referring to FIG. 3, the dithering cycle detector 610 of the signal controller 600 included in the display device according to an exemplary embodiment of the inventive concept stores the data of the input image signal IDAT of a predetermined test region A of a display area of the display panel 300 during an M frame (M is a natural number of 2 or more) to detect a frame in which the equal dithering data is repeated, thereby determining the dithering cycle. The test region A may have a×b matrix of pixels (a and b are natural numbers equal to or greater than 2) The test region A may be determined as a maximum size of the dithering pattern used in the graphic controller 700.

For example, the data of the input image signal IDAT for the one test region A may have the same data every 16 frames, so the dithering cycle may be determined to be 16 frames.

If, when detecting the dithering cycle, the data of the lower bit of the gray information of the input image signal IDAT for the test region A have a value "00" (e.g., full white or full black), it is determined that the input image signal IDAT of each frame is the same such that it is impossible to detect the dithering cycle. In this case, the determination of the dithering cycle is deferred and the dithering cycle detection is repeated at a later time or the dithering cycle detection may be performed after changed the test region A into other regions.

Referring to FIG. 4, the image of the test region A is changed in the frame in which the first dithering pattern of the dithering patterns is repeated. For example, as shown in FIG. 4, because the dithering cycle is 4 frames, the same pattern is periodically repeated every four frames. Thus, the fifth frame is designed to have the same dithering pattern as the first frame. If the motion picture image is generated in the fifth frame, the dithering cycle generator 610 may not recognize the actual dithering cycle as the 4 frames because the fifth frame has a different pattern from the first frame. As a result, the dithering cycle generator may recognize the dithering cycle as eight frames.

Accordingly, to prevent the incorrect detection of the dithering cycle, the dithering cycle detector 610 may determine the dithering cycle after repeating the detection of the dithering cycle until a repeated value of dithering cycle is obtained. The dithering cycle detector 610 may decides the repeated dithering cycle as the dithering cycle, thereby detecting error may be prevented. Next, referring to FIG. 5 and FIG. 6, when detecting the dithering cycle, the same dithering pattern may be periodically repeated within the dithering cycle. For example, as shown in FIG. 5, the actual dithering cycle is 8 frames, however the dithering pattern of the second frame, the fourth frame, the sixth frame, and the eighth frame may be the same. In this case, in the dithering cycle detector 610 may misjudge the dithering cycle as 2 frames.

To remove this misjudged, the dithering cycle detector 610 may decide the dithering cycle only when the same value (dithering cycle) appears more than two times as the actual dithering cycle.

Referring to FIG. 6, as shown in a step S1, a step S2, a step S3, . . . , a current frame is compared with a plurality of previous frames for one test region A to detect the dithering cycle. For example, when applying the dithering pattern of one set shown in FIG. 5, it is detected that the ninth frame is the same as the first frame in the step S1 such that it may be preliminarily determined that the dithering cycle is the 8 frames, and next, it is detected that the tenth frame is the same as the second frame, the fourth frame, the sixth frame, and the eighth frame in the step S2 such that it may be preliminarily determined that the dithering cycle is the 2 frames, and next again, it is detected that the eleventh frame is the same as the third frame in the step S3 such that it may be preliminarily determined that the dithering cycle is the 8 frames. In this case, the preliminary dithering cycle that is determined as the 2 frames does not occur more than two times, but the preliminary dithering cycle that is determined as the 8 frames occurs more than two times such that it may be correctly determined that the 8 frames is the actual dithering cycle.

Next, the display device according to an exemplary embodiment of the inventive concept will be described with reference to FIG. 7 as well as FIG. 1.

Figure 7:
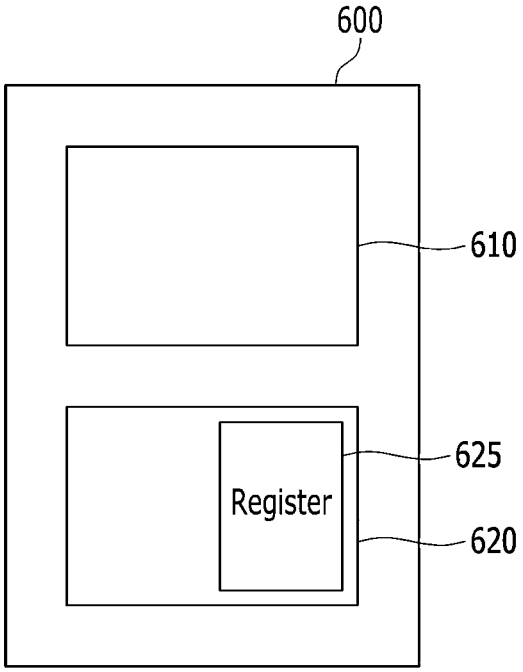
FIG. 7 is a block diagram of a signal controller included in a display device according to an exemplary embodiment of the inventive concept.

FIG. 7 is a block diagram of a signal controller included in a display device according to an exemplary embodiment of the inventive concept.

The display device according to the present exemplary embodiment is the same as the display device according to the exemplary embodiment shown in FIG. 1, except the still image detector 620 included in the signal controller 600 may further include a register 625. The register 625 may store a frame representative value for the entire display area or a frame representative value for a partial region of the display area. Here, the frame representative value means a representative value of the input image signal IDAT for the entire region or the partial region of the display area for the corresponding frame. For example, the frame representative value for one frame may be the data of the input image signal IDAT itself, or a sum thereof for the corresponding frame and the corresponding region.

Next, the driving method of the display device according to an exemplary embodiment of the inventive concept will be described with reference to FIG. 8 to FIG. 11 along with the previously described drawings.

Figure 8:
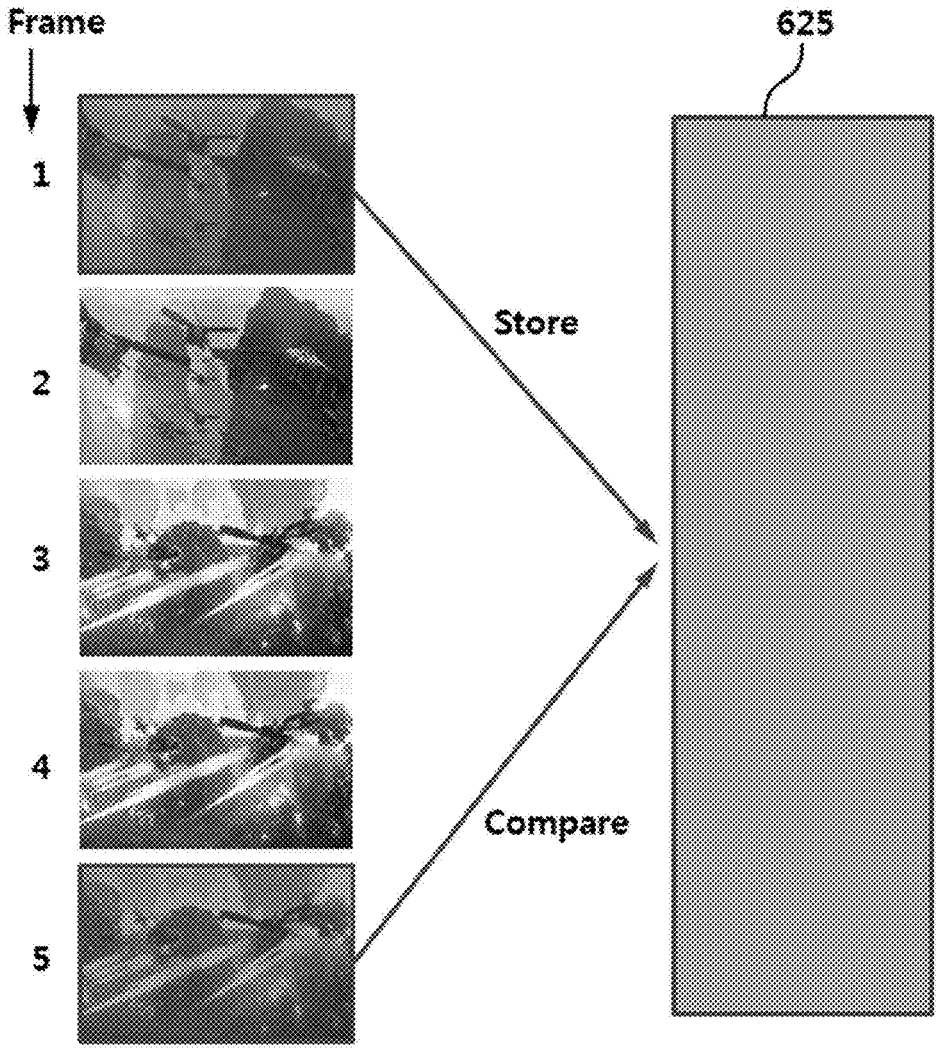
FIG. 8 to FIG. 10 are views showing a method of detecting a frame in which a still image or a motion picture image is generated in a display device according to an exemplary embodiment of the inventive concept.
Figure 9:
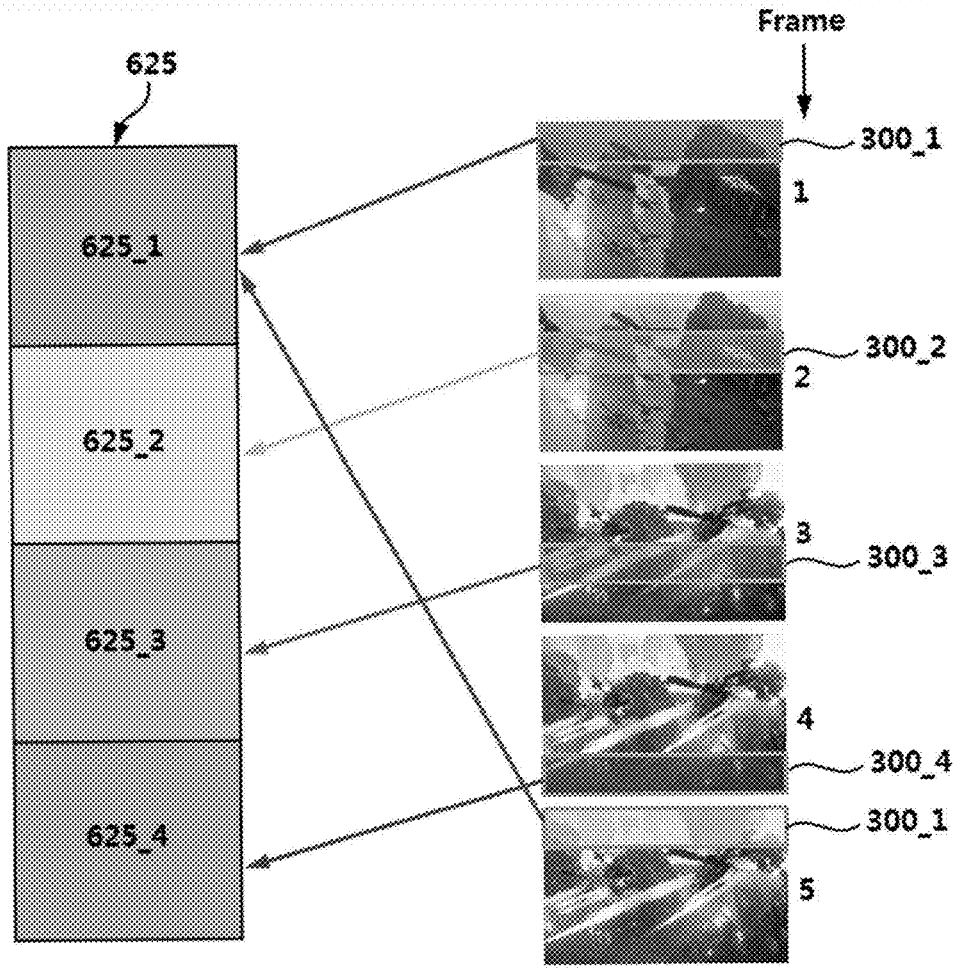
Figure 10:
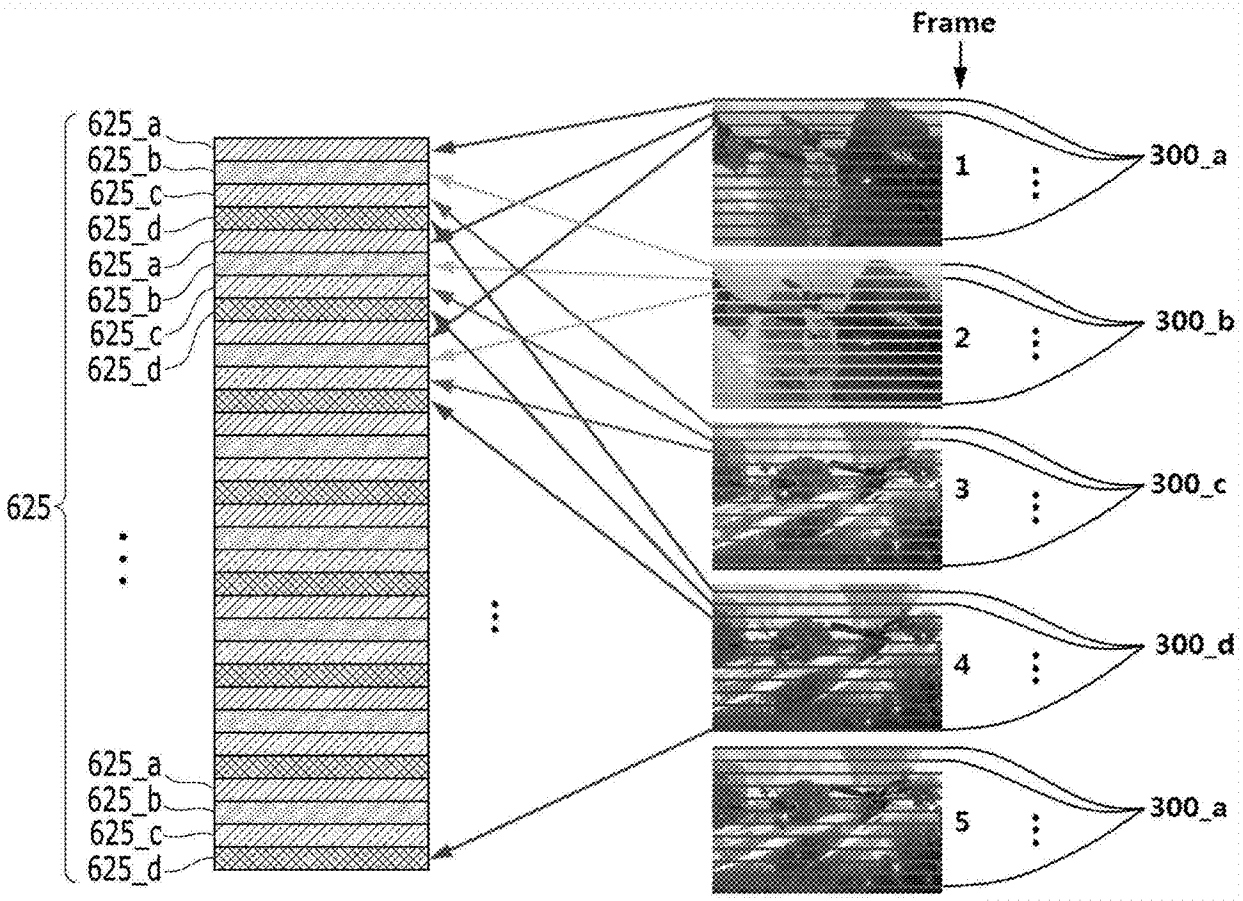
Figure 11:
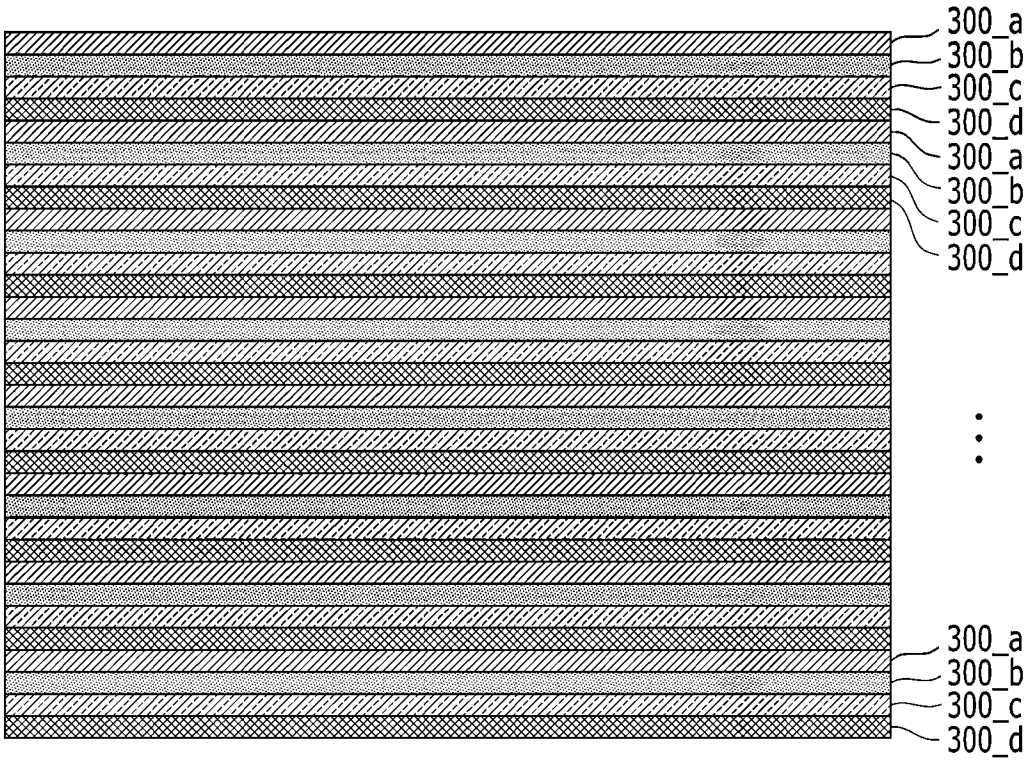
FIG. 11 is a view of one example of a method of dividing an image of one frame in a display device according to an exemplary embodiment of the inventive concept.

FIG. 8 to FIG. 10 are views showing a method of detecting a frame in which a still image or a motion picture image is generated in a display device according to an exemplary embodiment of the inventive concept, and FIG. 11 is a view of one example of a method of dividing an image of one frame in a display device according to an exemplary embodiment of the inventive concept.

Firstly, referring to FIG. 8, an example in which the dithering cycle detected in the dithering cycle detector 610 is the 4 frames will be described. The still image detector 620 may store the frame representative value of the previous dithering cycle to the register 625, and may compare it to decide whether the current frame is the still image or the motion picture image. The frame representative value stored in the register 625 may be any one frame representative value of a predetermined dithering pattern among the dithering patterns of one set.

FIG. 8 shows an example in which the input image signal IDAT corresponding to the first dithering pattern among the dithering patterns of one set is stored to the register 625. The stored dithering pattern is compared with a dithering pattern of the subsequent frames for every dithering cycle. However, as shown in FIG. 8, when the motion picture image is generated in a frame that is not stored in the register 625 and, thus, is not compared, the still image detector 620 may not detect an exact frame in which the motion picture image is generated. For example, when the motion picture image is generated in the third frame positioned within the dithering cycle which is four frames, the frame in which the motion picture image starts is misjudged as the fifth frame because only the dithering pattern of the first frame is stored in the register 625 and is compared with the fifth dithering pattern such that the display operation may not be smooth. The misjudged occurs because the frame representative value is compared with the subsequent frame value every 4 frames that is the detected dithering cycle.

To prevent the misjudged, as shown in FIG. 9, the display area may be divided into the same number of the dithering cycle and the frame representative value of each divided display area may be stored in the corresponding register 625-1, 625-2, 625-3 and 625-4 to increase sampling frequencies of the frame representative value for each group.

For example, referring to FIG. 9, the display area may be divided into a first sub-display area 300_1, a second sub-display area 300_2, a third sub-display area 300_3, and a fourth sub-display area 300_4 that are disposed sequentially from an upper side. Corresponding thereto, the register 625 may also be divided into a first register unit 625_1 storing the frame representative value for the first sub-display area 300_1, a second register unit 625_2 storing the frame representative value for the second sub-display area 300_2, a third register unit 625_3 storing the frame representative value for the third sub-display area 300_3, and a fourth register unit 625_4 storing the frame representative value for the fourth sub-display area 300_4.

According to the present exemplary embodiment, the first register unit 625_1 stores the frame representative value of the first sub-display area 300_1 of the first frame, the second register unit 625_2 stores the frame representative value of the second sub-display area 300_2 of the second frame, the third register unit 625_3 stores the frame representative value of the third sub-display area 300_3 of the third frame, and the fourth register unit 625_4 stores the frame representative value of the fourth sub-display area 300_4 of the fourth frame. The register units 625_1, 625_2, 625_3, and 625_4 compare the frame representative value stored in the register 625 with the frame representative value for the corresponding sub-display areas 300_1, 300_2, 300_3, and 300_4 of the current frame to detect whether the current frame is the motion picture image or the still image. Accordingly, by comparing the frame representative values of the corresponding sub-display areas 300_1, 300_2, 300_3, and 300_4 with the frame representative values stored in the corresponding register units 625_1, 625_2, 625_3, and 625_4, the position and frame in which the motion picture image is generated may be correctly determined.

Particularly, according to the exemplary embodiment shown in FIG. 9, the sub-display areas 300_1, 300_2, 300_3, and 300_4 that are subjected to the storing and comparing of the frame representative value are not limited to any one region, but are dispersed into the entire display area such that the motion picture image and the still image may be correctly detected even though the motion picture image is generated in the partial region of the display area.

Referring to FIG. 10 and FIG. 11, the method of dividing the display area is not limited to that shown in FIG. 9, and may vary.

For example, as shown in FIG. 10, the entire display area may be divided into a plurality of sub-display areas 300_*a*, 300_*b*, 300_*c*, and 300_*d* that are alternately repeated along a first direction. FIG. 10 shows an example of dividing the display area into four sub-display areas 300_*a*, 300_*b*, 300_*c*, and 300_*d* and the four sub-display areas 300_*a*, 300_*b*, 300_*c*, and 300_*d* are repeated several times throughout one frames, however the number of divided sub-display areas 300_*a*, 300_*b*, 300_*c*, and 300_*d* is not limited thereto.

FIG. 11 shows an example in which the display area displaying one image is divided into a plurality of sub-display areas 300_*a*, 300_*b*, 300_*c*, and 300_*d*, as shown in FIG. 10.

Accordingly, the register 625 may also be divided into a plurality of register units 625_*a*, 625_*b*, 625_*c*, and 625_*d* that are alternately repeated and disposed corresponding to a plurality of divided sub-display areas 300_*a*, 300_*b*, 300_*c*, and 300_*d*. A plurality of first register units 625_*a* respectively store the frame representative value for a plurality of first sub-display areas 300_*a* sequentially from the upper side, a plurality of second register units 625_*b* respectively store the frame representative value for a plurality of second sub-display areas 300_*b* sequentially from the upper side, a plurality of third register units 625_*c* respectively store the frame representative value for a plurality of third sub-display areas 300_*c* sequentially from the upper side, and a plurality of fourth register units 625_*d* respectively store the frame representative value for a plurality of fourth sub-display area 300_*d* sequentially from the upper side.

According to the present exemplary embodiment, the plurality of first register units 625_*a* store the frame representative value of a plurality of first sub-display area 300_*a* of the first frame, the second register unit 625_*b* stores frame representative value of a plurality of second sub-display areas 300_*b* of the second frame, the third register unit 625_*c* stores the frame representative value of a plurality of third sub-display areas 300_*c* of the third frame, and the fourth register unit 625_*d* stores the frame representative value of a plurality of fourth sub-display areas 300_*d* of the fourth frame. The register units 625-*a*, 625-*b*, 625-*c*, and 625-*d* respectively compare the frame representative values stored as the unit of the dithering cycle with the frame representative values for the corresponding sub-display areas 300_*a*, 300_*b*, 300_*c*, and 300_*d* of the current frame to detect the motion picture image or the still image. Accordingly, by comparing the frame representative values of the corresponding sub-display areas 300_*a*, 300_*b*, 300_*c*, and 300_*d* with the frame representative values stored to the corresponding register units 625-*a*, 625-*b*, 625-*c*, and 625-*d* for each frame, the position of the frame at which the motion picture image is generated may be correctly determined.

Particularly, according to the exemplary embodiment shown in FIG. 9, the sub-display areas 300_*a*, 300_*b*, 300_*c*, and 300_*d* that are subjected to the storing and comparison of the frame representative value are not limited to any one region, but are dispersed into the entire display area and are further more minutely divided than the exemplary embodiment shown in FIG. 9 such that the motion picture image and the still image may be comparatively and correctly detected even though the motion picture image is generated in the partial region of the display area.

Next, the driving method of the display device according to an exemplary embodiment of the inventive concept, in detail, the method of detecting the frame in which the still image or the motion picture image is generated based on the detected dithering cycle and the input image signal IDAT will be described with reference to FIG. 12 to FIG. 14 along with the previously described drawings.

Figure 12:
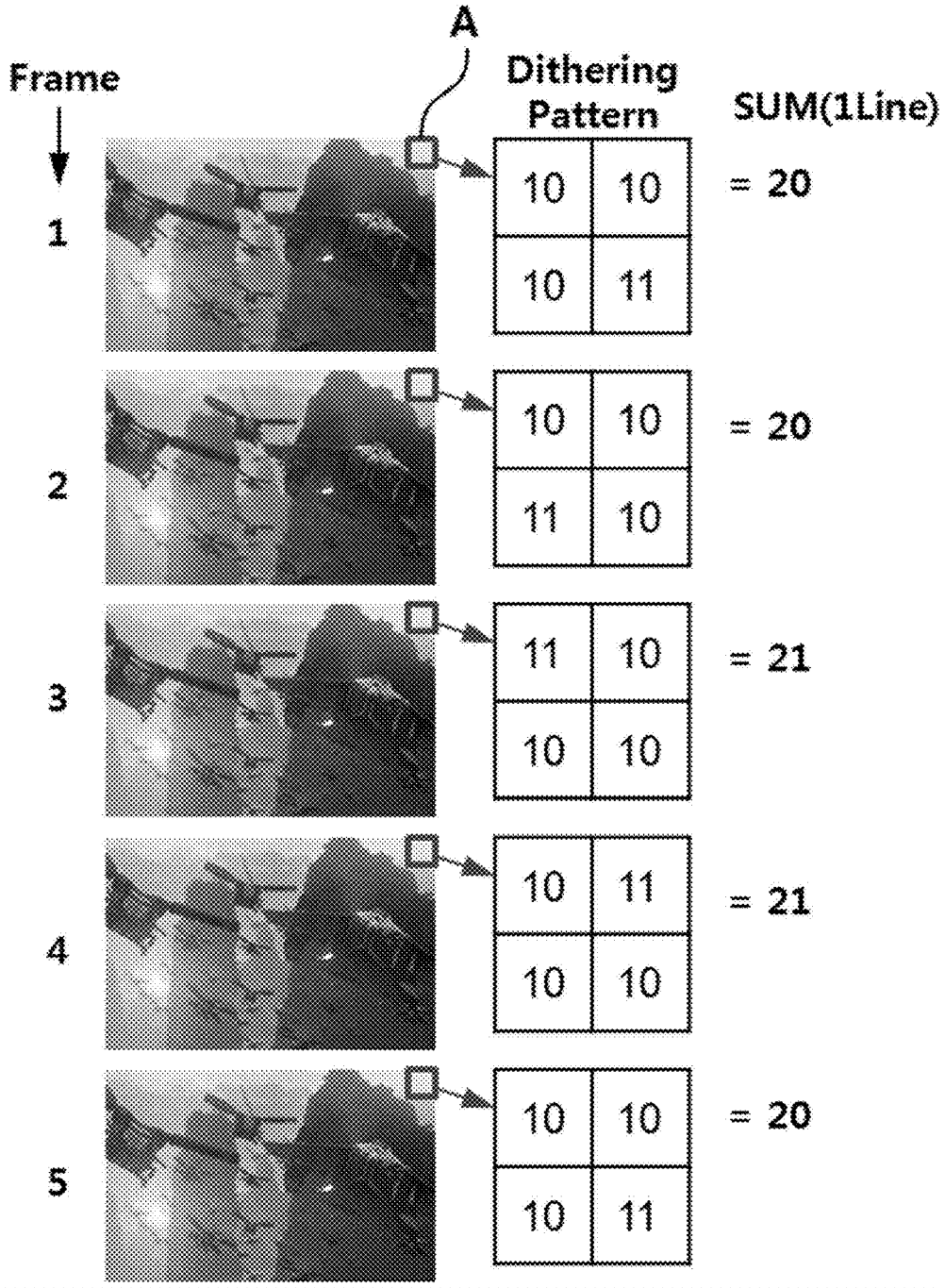
FIG. 12 and FIG. 13 are views showing a method of detecting a frame in which a still image or a motion picture image is generated in a display device according to an exemplary embodiment of the inventive concept.
Figure 13:
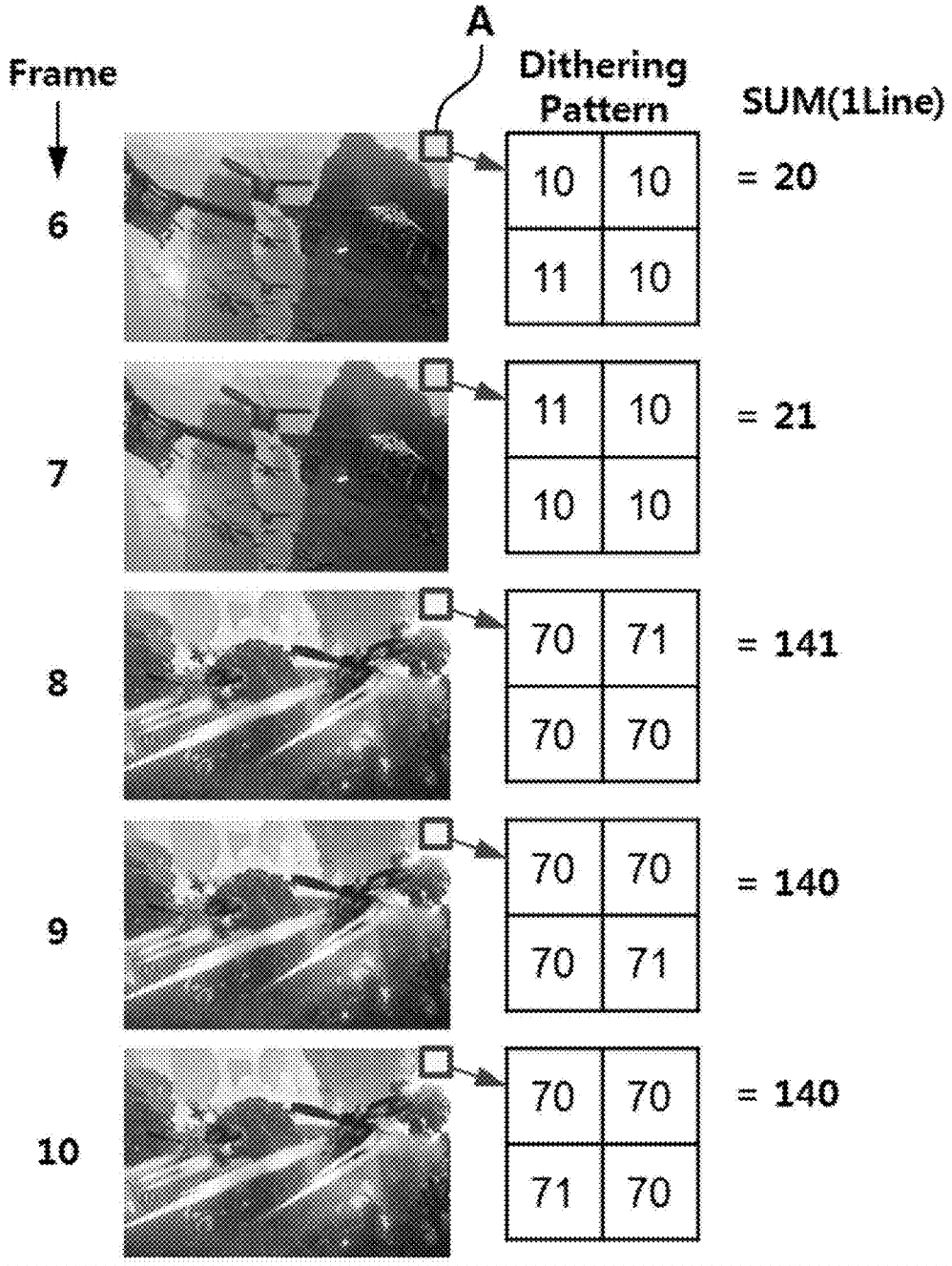

FIG. 12 and FIG. 13 are views showing a method of detecting a frame in which a still image or a motion picture image is generated in a display device according to an exemplary embodiment of the inventive concept, and FIG. 14 is a view showing another method of detecting a frame in which a still image or a motion picture image is generated for an image of several frames shown in FIG. 12 and FIG. 13.

According to an exemplary embodiment of the inventive concept, the frame where the still image and the motion picture image are generated may be further correctly detected by using a temporal and spatial accumulation sum method.

Referring to FIG. 12 and FIG. 13, the still image detector 620 may sum the frame representative value for the pixels PXs included in the test region A, for example, all data of the input image signal IDAT, the frame representative value of the partial pixels PXs of the test region A, to obtain a sum value SUM.

FIG. 12 and FIG. 13 are examples in which the frame representative values for a first line of the test region A are summed to obtain the sum value SUM when the size of the dithering pattern and the test region A is 2×2. In this case, if the sum value SUM is maintained as a similar level like 20 or 21 until the seventh frames and then has the large difference from the sum value SUM from the previous frame like 140 or 141 from the eighth frame, it may be determined that the motion picture image is generated in the corresponding frame, that is, the eighth frame.

Referring to FIG. 14, the frame sum value FSUM may be obtained by accumulating and summing the sum value SUM of the frame number by the detected dithering cycle. As described above, the sum value SUM may be a sum of the frame representative value for the entire or partial line of the test region A. For example, the frame sum value FSUM may be the value of the sum values SUM of the first to fourth frames, the value of the sum values SUM of the second to fifth frames, the value of the sum values SUM of the third to sixth frames, etc., while the current frame is changed. Referring to FIG. 14, when the frame sum value FSUM of the frame is suddenly and largely changed, it may be determined that the motion picture image is generated in the corresponding frame. For example, as shown in FIG. 14, when the frame sum value FSUM of the previous frame has the value of 82, and the frame sum value FSUM summing the sum values SUM of the fifth to eighth frames is suddenly increased, it may be determined that the motion picture image is generated in the eighth frame.

As described, when comparing the sum value SUM or the frame sum value FSUM including the sum of the frame representative value, the change of the sum value SUM or the frame sum value FSUM is increased when the motion picture image is generated, compared with the frame representative value of each frame such that the still image or the motion picture image may be further correctly detected.

While this inventive concept has been described in connection with what is presently considered to be practical exemplary embodiments, it is to be understood that the inventive concept is not limited to the disclosed embodiments, but, on the contrary, is intended to cover various modifications and equivalent arrangements included within the spirit and scope of the appended claims.

What is claimed is:

1. A display device comprising:

a display panel including a plurality of pixels and a plurality of data lines;

a graphic controller configured to output an input image signal that is dithered based on dithering patterns of one set and has image information;

a data driver configured to apply data voltages to the plurality of data lines; and a signal controller configured to receive the dithered input image signal from the graphic controller and control the data driver, wherein the signal controller includes a dithering cycle detector configured to detect a dithering cycle by comparing the dithered input image signal of a frame with the dithered input image signal of at least one other frame, the dithering cycle being a number of frames by which the dithering patterns of one set are repeated in the dithered input image signal from the graphic controller, and a still image detector configured to determine whether a current frame is a frame displaying a still image or a frame displaying a motion picture image based on the detected dithering cycle and the input image signal, and wherein the still image detector includes a register storing a frame representative value, a display area of the display panel is divided into a plurality of sub-display areas, the register includes a plurality of register units respectively storing the frame representative value for the respective plurality of sub-display areas, the plurality of sub-display areas are alternately repeated in one direction, and the plurality of register units are alternately repeated in the same direction.

2. The display device of claim 1, wherein the dithering cycle detector is configured to set a test region of the display panel, and store and compare data of the input image signal for the test region during a plurality of frames to detect frames in which same data is repeated periodically, thereby determining the dithering cycle.

3. The display device of claim 2, wherein when data of a lower bit of gray information represented by the input image signal for the test region is "00", the dithering cycle detector is configured to detect the dithering cycle by repeating detection of the dithering cycle or changing the test region.

4. The display device of claim 2, wherein the dithering cycle detector repeats detecting dithering cycles until a repeated dithering cycle is obtained and determines the repeated dithering cycle as the dithering cycle.

5. The display device of claim 4, wherein the still image detector includes a register storing a frame representative value, and the still image detector compares the frame representative value stored in the register with the frame representative value of the current frame for every dithering cycle to determine whether an image of the current frame is the still image or the motion picture image.

6. The display device of claim 2, wherein the still image detector compares the frame representative value stored in the register with the frame representative value of the current frame for every detected dithering cycle to determine whether an image of the current frame is the still image or the motion picture image.

7. The display device of claim 2, wherein the still image detector obtains a sum value of frame representative values for two or more pixels among the pixels included in the test region and determines that the motion picture image is generated in a frame in which the sum value is changed relatively more than other frames, or obtains a frame sum value by accumulating and summing the sum values of a number of frames same as the dithering cycle and determines that the motion picture image is generated in a frame in which the frame sum value is changed relatively more than other frames.

8. A method of driving a display device including a display panel including a plurality of pixels and a plurality of data lines, a data driver, a signal controller for controlling the data driver, and a graphic controller, the method comprising:

inputting an input image signal that is dithered based on dithering patterns of one set and has image information by the graphic controller to the signal controller;

detecting a dithering cycle by comparing the dithered input image signal of a frame with the dithered input image signal of at least one other frame, the dithering cycle being a number of frames by which the dithering patterns of one set are repeated in the dithered input image signal from the graphic controller; and determining whether a current frame is a frame displaying a still image or a frame displaying a motion picture image based on the detected dithering cycle and the dithered input image signal, wherein the determining of whether the current frame is the frame displaying the still image or the frame displaying the motion picture image includes storing a frame representative value for each frame, a display area of display panel is divided into a plurality of sub-display areas, the storing of the frame representative value for each frame includes respectively storing the frame representative value for the respective plurality of sub-display areas, the plurality of sub-display areas are alternately repeated in one direction, and the storing of the frame representative value for each frame includes alternately storing the frame representative value for the respective plurality of sub-display areas.

9. The method of claim 8, wherein the detecting of the dithering cycle includes setting a test region of the display panel, and storing and comparing data of the input image signal for the test region during a plurality of frames to detect frames in which a same data is repeated.

10. The method of claim 9, wherein the detecting of the dithering cycle further includes detecting the dithering cycle by repeating the detecting of the dithering cycle or changing the test region when data of a lower bit of gray information represented by the input signal for the test region is "00".

11. The method of claim 9, wherein the detecting of the dithering cycle is performed repeatedly until a repeated dithering cycle is obtained and the repeated dithering cycle among detected dithering cycles is determined as the dithering cycle.

12. The method of claim 11, wherein the determining whether a current frame is a frame displaying a still image or a frame displaying a motion picture image includes:

storing a frame representative value for each frame in a register, and comparing the stored frame representative value stored in the register with the frame representative value of the current frame for every detected dithering cycle to determine whether an image of the current frame is the still image or the motion picture image.

13. The method of claim 9, wherein the determining of whether the current frame is the frame displaying the still image or the frame displaying the motion picture image includes comparing the stored frame representative value with the frame representative value of the current frame for every detected dithering cycle to determine whether an image of the current frame is the still image or the motion picture image.

14. The method of claim 9, wherein in the determining of whether the current frame is the frame displaying the still image or the frame displaying the motion picture image, a sum value of the frame representative values for two or more pixels among the pixels included in the test region is obtained, and it is determined that the motion picture image is generated in a frame in which the sum value is changed relatively more than other frames, or a frame sum value is obtained by accumulating and summing the sum values of a number of frames same as the dithering cycle, and it is determined that the motion picture image is generated in a frame in which the frame sum value is changed relatively more than other frames.

* * * * *